United States Patent [19]

Yamada et al.

[11] Patent Number: 4,765,465

[45] Date of Patent: Aug. 23, 1988

[54] EATING UTENSILS HAVING A SOUND GENERATING MEANS

[76] Inventors: Katuyuki Yamada, Ikeda-cho, 9-chome, Tajimi-shi 507; Ekio Isihama, Asahi-machi, Tsumagi-cho, Toki-shi 509-53, both of Japan

[21] Appl. No.: 113,393

[22] Filed: Oct. 19, 1987

Related U.S. Application Data

[63] Continuation of Ser. No. 754,861, Jul. 12, 1985.

[51] Int. Cl.[4] ..... B65D 77/00

[52] U.S. Cl. ..... 206/217; 215/100 R; 206/527; 369/63

[58] Field of Search ..... 206/217, 527; 215/1 R, 215/11 C, 100 R; 40/455; 200/52 R, DIG. 20, DIG. 36; 369/63; 446/397

[56] References Cited

U.S. PATENT DOCUMENTS

| | | | |
|---|---|---|---|
| 465,795 | 12/1891 | Sveur | 215/100 R |
| 2,577,030 | 12/1951 | Neumann | 215/100 R |
| 2,663,866 | 12/1953 | Simpson | 200/52 R |
| 3,226,528 | 12/1965 | Martin | 369/63 |
| 3,627,161 | 12/1971 | Wergeland | 215/11 C |
| 3,983,350 | 9/1976 | Camin | 200/52 R |
| 4,263,734 | 4/1981 | Bradshaw | 215/100 R |
| 4,528,559 | 7/1985 | Freeman | 200/DIG. 20 |
| 4,531,310 | 7/1985 | Acson et al. | 40/455 |
| 4,607,747 | 8/1986 | Steiner | 40/455 |

FOREIGN PATENT DOCUMENTS

| | | | |
|---|---|---|---|
| 1282137 | 2/1964 | Fed. Rep. of Germany | 200/DIG. 36 |
| 86481 | 7/1869 | France | 215/100 R |
| 1358543 | 3/1964 | France | 446/397 |
| 43993 | 3/1985 | Japan | 200/DIG. 20 |
| 8102215 | 8/1981 | PCT Int'l Appl. | 40/455 |
| 2155858 | 10/1985 | United Kingdom | 40/455 |

*Primary Examiner*—David T. Fidei

*Attorney, Agent, or Firm*—Cooper & Dunham

[57] ABSTRACT

A ceramic cup has a sound generating circuit at the bottom to produce a melody when the cup is lifted up from, for example, a table. This gives a wonder and pleasant impression for those using it. The synthetic resin is cast into a hard layer in generally integral with the bottom of the cup, making the layer believe to be a part of the cup, at the same time, rendering the layer substantially immune to inadvertent removal.

2 Claims, 3 Drawing Sheets

EATING UTENSILS HAVING A SOUND GENERATING MEANS

This is a continuation of application Ser. No. 754,861, filed July 12, 1985.

BACKGROUND OF THE INVENTION

1. Field of the Invention

The present invention relates to eating utensils having an electronic circuit for generating a sound such as a singing voice or a musical accompaniment upon using the eating utensils such as, for example, a coffee cup.

2. Description of the Prior Art

The eating utensils such as a coffee cup has already been introduced into the market. This eating utensils has a sound generating circuit at its bottom, and adapted to produce a melodious tune when the utensils is lifted up from table or the like. Because the circuit has a photosensitive switch which is activated when subjected to optical circumstances.

In this instance, the circuit reduced into printed circuit board is interfit into a cavity provided with the bottom of the cup by means of mechanical engagement. Such is the mounting construction of the circuit board that the board is liable to be inadvertently removed, together with reducing the outer appearance, collecting dirty materials and water beads due to a marginal zone established between the cavity and the board. The former one frequently occurs from the fact that a dish washing machine is employed to clean the eating utensils in these days. The latter two things particularly poses a sanitary problem.

Accordingly, it is first object of the invention to provide eating utensils, the sound generating means of which is completely covered by a synthetic resin in generally integral therewith, leading to good appearance, securing liquid tightness and preventing the sound generating means from being inadvertently removed.

It is second object of the invention to provide eating utensils to give an impression hightening wonder and pleasure particularly for those using it for the first time.

It is third object of the invention to provide eating utensils capable of obviating the possibility that a sound generating means is inadvertently removed to give a damage when cleaning it, and overcoming a sanitary problem such as water beads and dirty materials collected at the bottom.

It is fourth object of the invention to provide eating utensils having a cavity to accommodate a sound generating means, the cavity contributing its inner space to add a resonance effect.

It is further object of the invention to provide eating utensils with a sound generating means having a solar battery cell rechargeable each time when subjected to optical circumstances.

DETAILED DESCRIPTION OF THE PREFERRED EMBODIMENTS

Figure 1:
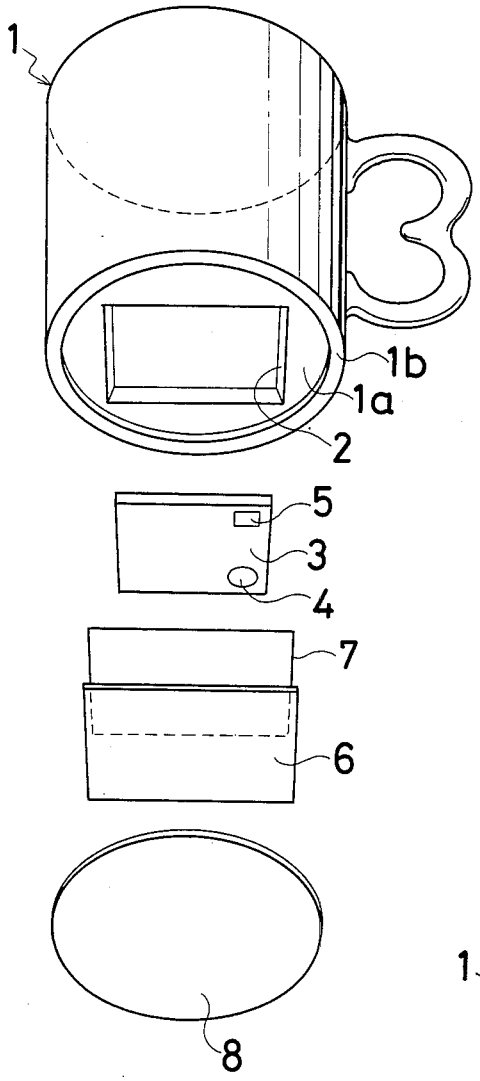
FIG. 1 is an expanded perspective view of eating utensils according to first embodiment of the invention.
Figure 2:
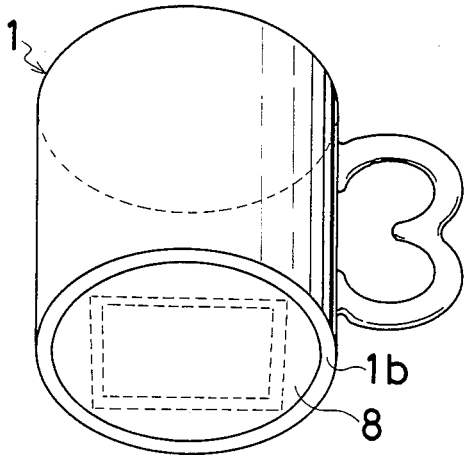
FIG. 2 is a perspective view of eating utensils according to the first embodiment.
Figure 3:
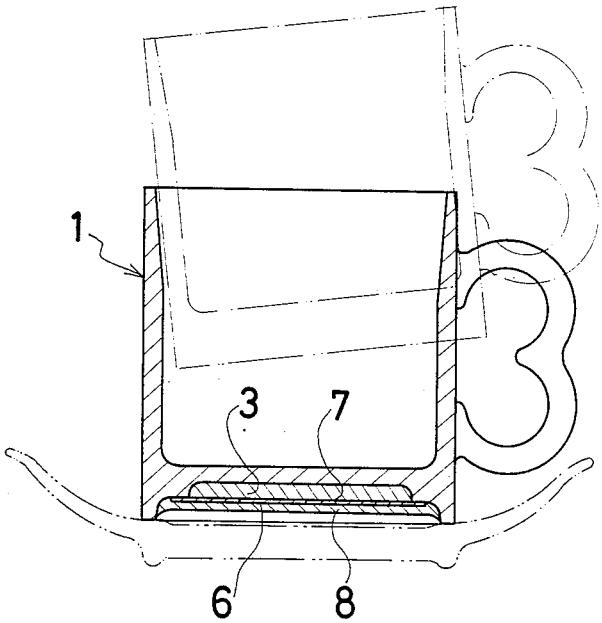
FIG. 3 is a longitudinal cross sectional view of eating utensils according to the first embodiment of the invention.

Referring to the drawings from FIG. 1 to FIG. 3, a first embodiment of the invention is described hereinafter. A eating utensils taken a coffee cup as an example, the coffee cup which is made from earthenware is designated by numeral 1. At the bottom of the cup 1 is a rectangular-shaped cavity 2 provided, into which an electronic circuit board 3 is accommodated to serve as a sound generating means. The circuit board 3 is 20 (mm) at length, 15 (mm) at width and 3 (mm) at thickness, and well known type comprising a melody storage circuit, an amplifier, a flat speaker, a mercury battery cell 4 and a photosensitive switch 5. A liquid impermeable sheet 6, the area of which is somewhat smaller than that of the bottom 1*a* of the cup 1, is attached to the bottom 1*a* to seal the opening of the cavity 2. Between the sheet 6 and the circuit board 3, provided a binder paper 7, the double sides of which a sticky agent is applied to retain the board 3 on the sheet 6, thus preventing the board 3 from making a noise when the cup 1 is lifted, and at the same time, securing the board 3 against an inadvertant removal. Into the annular area of the bottom 1*a*, is a liquid epoxy-base synthetic resin 8 flowed to cast a flush hard layer in generally integral with the bottom 1*a* when the resin 8 has been cured, as clearly seen in FIG. 2. With the structure thus described, lifting the cup 1 from the position of solid line to that of phantom line, occurs to subject the bottom 1*a* to optical atmosphere. As a consequence, the light passes through the layer 8, the sheet 6 and the paper 7 to fall on the switch 5 so that the photosensitive switch 5 is activated to energize the electronic circuit so as to generate a sound. Upon resting the cup 1 on a table, for example, the light incident on the bottom is interrupted to inactivate the photosensitive switch 5 so as to quiet the sound.

Figure 4:
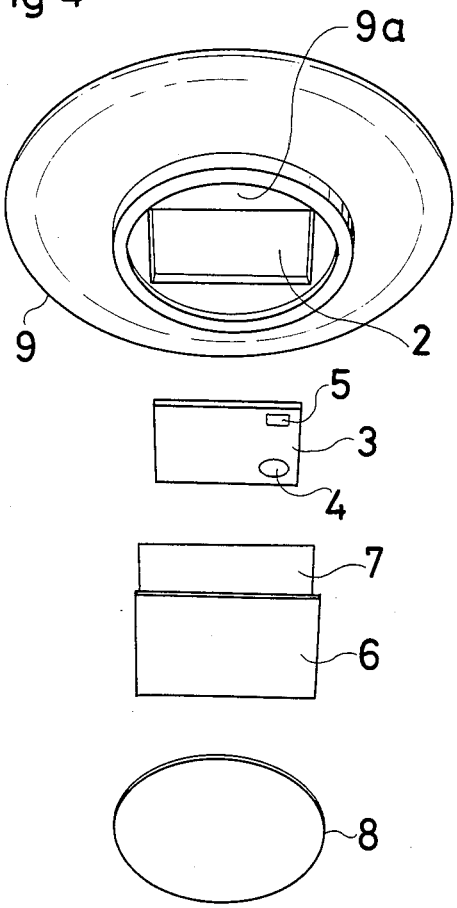
FIG. 4 is a view similar to FIG. 1 according to second embodiment of the invention.
Figure 5:
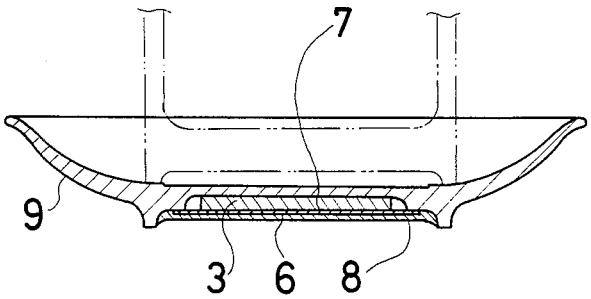
FIG. 5 is a view similar to FIG. 3 according to the second embodiment of the invention.

FIG. 4 and FIG. 5 show a second embodiment of the invention. In this embodiment, the circuit board 3 is provided with the bottom 9*a* of an earthenware plate 9 on which a coffee cup is rested.

Figure 6:
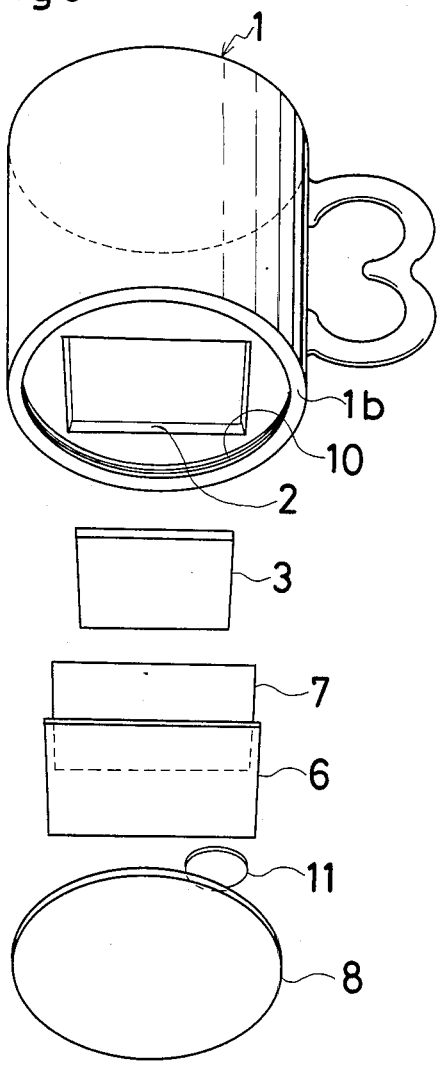
FIG. 6 is a view similar to FIG. 1 according to the third embodiment of the invention.
Figure 7:
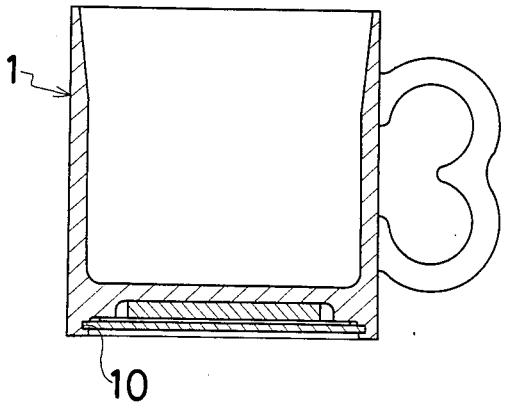
FIG. 7 is a view similar to FIG. 3 according to the third embodiment of the invention.

FIG. 6 and FIG. 7 show a third embodiment of the invention. In this embodiment, the bottom 1*a* of the cup 1 has a circular groove 10 at the inner side of an annular flange 1*b*. Upon casting the layer 8, the layer 8 interfit its peripheral portion into the groove 10 to secure the layer against removal even though the cup would be frequently cleaned even by a dishwashing machine or the like. Between the layer 8 and the sheet 6 is a solar battery cell 11 provided which is recharged each time when the cup is lifted.

In the above embodiments, like numerals designates like component parts all through the drawings.

Under the circumstances in which the layer is desired to resemble the coffee cup as a whole to make the layer superficially identical to the cup, an epoxy-related glaze may be applied to the outer side of the layer for procelain eating utensils. In addition, synthetic resins which have self-adhering property may be used such as polyester-based and polyurethane-based plastics. Upon employing "EPODUCT" trade marked from Showa High-Polymer Manufacturing Co., curing agent, white pigment, butyl or ethyl acetate, are mixed to add to the primary liquid resin at the weight ratio, 1:1/5:1/20:2 in this order. The liquid thus mixed produces unfavorable pneumatic foams due to its high viscosity particularly when hand mixing machine is used. With an eye to obviating the foams, the liquid resin should be flowed through a funnel made from Japanese paper or non-woven texture. Otherwise, a hot air may be blewn on an upper extend of the resin.

In addition, a liquid impermeable sheet should be made of a foolscap on which a resin is coated.

It is appreciated that a circuit board may be fixed to the upper side of a cavity by means of adhering agent.

Instead of a photosensitive switch, means such as a liquid mercury switch, a pressure sensitive switch, a thermosensitive switch or a soundsensitive switch may be used. A timer may be incorporated into a circuit board to energized it for a predetermined period of time when a cup is used.

Inner sides of a cavity may be deformed as desired to delicately alter a resonancing acoustic effect.

What is claimed is:

1. An eating utensil having a sound generating means comprising:

(a) a flanged bottom portion providing the circumferential peripheral bottom of an eating utensil which contacts a setting plane so as to be obscured from ambient light at the time of placing the bottom of the eating utensil on the setting plane;

(b) a recessed portion within the bottom of said eating utensil so as to be in concentrical relationship with said flanged bottom portion;

(c) an electronic circuit located in the recessed portion of said eating utensil to generate a sound upon energization;

(d) a battery cell incorporated into said electronic circuit as a power source thereof;

(e) a light permeable, cast synthetic resin layer positioned within said recessed portion in contact with the inside of said flange to provid a liquid-tight seal for said electronic circuit;

(f) a photo-sensitive switch provided is said electronic circuit to be exposed to the ambient light transmitted through said synthetic resin layer to energize said electronic circuit;

(g) a translucent, liquid-impermeable sheet, the area of which is somewhat smaller than that of said flanged bottom portion provided between said electronic circuit and said light permeable layer to protect said electronic circuit against the synthetic resin at the time of casting, and a translucent binder paper sheet having a sticky adhesive at both sides placed between said electronic circuit and said translucent, liquid-impermeable sheet to fix said sound generating electronic circuit in place.

2. An eating utensil having a sound generating as recited in claim 1, in which said light permeable resin layer is thermosetting plastic material.

* * * * *